United States Patent [19]

Williams

[11] 3,951,505

[45] Apr. 20, 1976

[54] STRAIN RELIEF SYSTEM FOR ELECTRICAL CONNECTORS

[76] Inventor: Robert A. Williams, 55 Bounty Road East, Fort Worth, Tex.

[22] Filed: May 1, 1975

[21] Appl. No.: 573,744

[52] U.S. Cl. ..... 339/103 M; 339/97 P

[51] Int. Cl.[2] ..... H01R 13/58

[58] Field of Search ..... 339/103, 97 R, 97 P, 339/99 R, 139 R

[56] References Cited

UNITED STATES PATENTS 3,465,092 9/1969 Schwartz ..... 339/103 M X

FOREIGN PATENTS OR APPLICATIONS 2,153,871 3/1972 Germany ..... 339/97 P

*Primary Examiner*—Roy Lake
*Assistant Examiner*—DeWalden W. Jones
*Attorney, Agent, or Firm*—Wofford, Felsman, Fails & Zobal

[57] ABSTRACT

A strain relief system for individually clamping the conductors extending from the rear end of an electrical connector. The strain relief system comprises a circular wafer having a plurality of angularly spaced slots for receiving the conductors to allow the wafer to be located next to the rear of the connector with a conductor located in each slot. A shell is adapted to be fitted around the wafer and threaded to the housing of the connector. Formed through the shell are a plurality of spaced openings for alignment with the slots when the shell is threaded in place. Inserts are adapted to be inserted through the openings into the slots for engaging each conductor and a clamping band is employed for surrounding the shell and engaging the outer ends of the inserts for clamping the inserts in place in the slots against the conductors.

4 Claims, 8 Drawing Figures

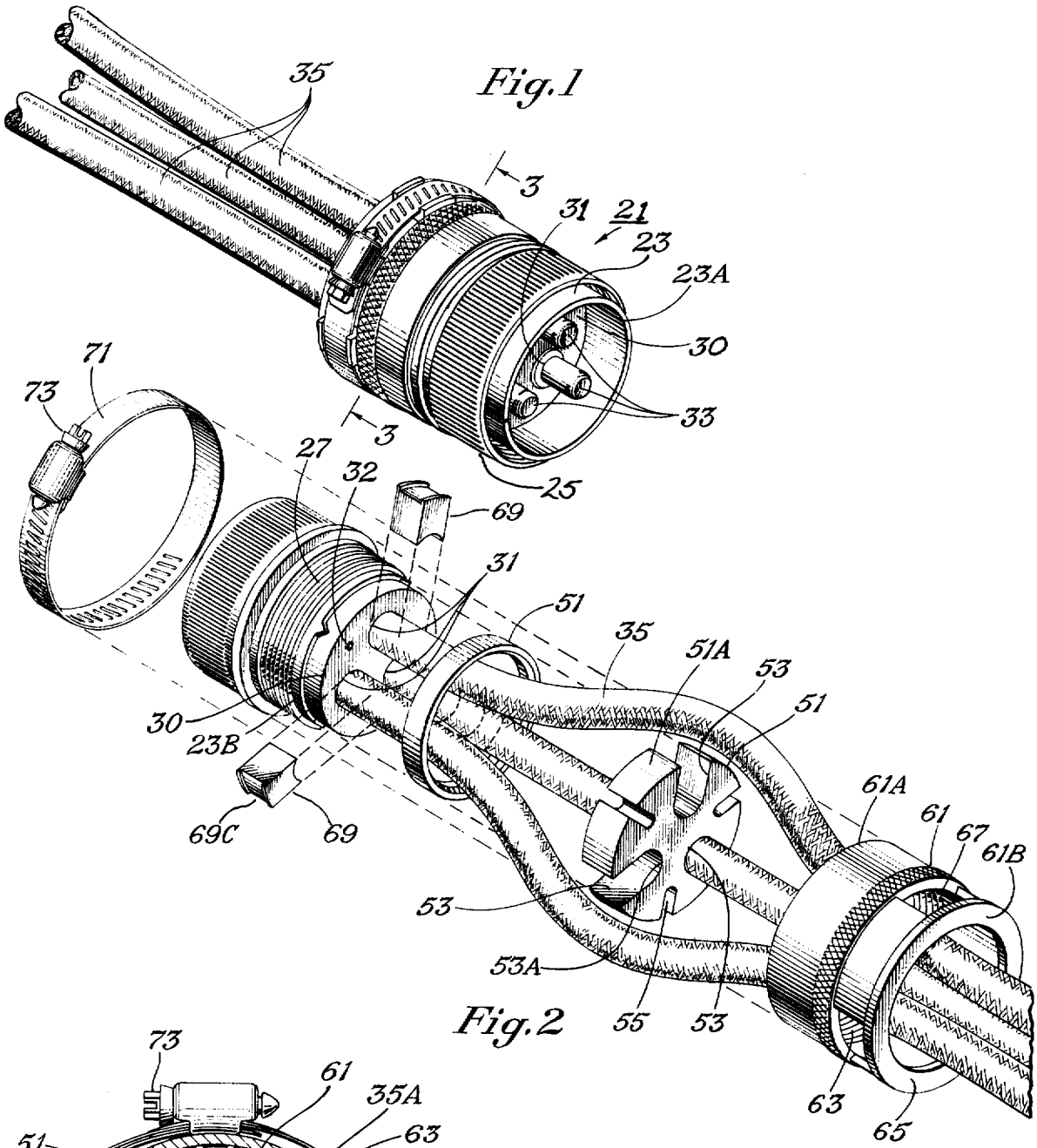
Fig. 1
Fig. 2
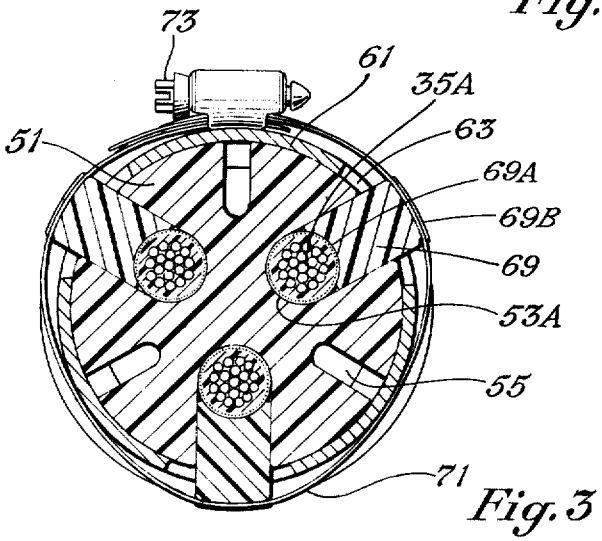
Fig. 3

STRAIN RELIEF SYSTEM FOR ELECTRICAL CONNECTORS

BACKGROUND OF THE INVENTION:

This invention relates to a strain relief system for an electrical connector and more particularly to a strain relief system for individually clamping the conductors extending from the rear end of an electrical connector.

In helicopter operations, heavy duty ground leads are employed for supplying electrical power to the helicopter for start-up purposes after which the leads are disconnected from the helicopter. Female electrical connectors are connected to the ground leads which mate with male connectors connected to heavy duty leads on the helicopter for connect and disconnect purposes. The connectors in use comprise a housing having a flexible grommet located in the housing; a plurality of contact members supported by the grommet at the front end; and a plurality of heavy duty electrical conductors crimped to the contacts and extending through the grommet from the rear end of the connector. A thin spring retention clip is employed in the housing for retaining the contacts in the desired position. Although connectors of this type have been used for a period of time, they have disadvantages in that a load on the conductors or contacts may damage or destroy the thin retention clip, resulting in the contacts being displaced from their position or canted. This may occur during connect or disconnect operations or during installation of the leads on a helicopter.

Damage to the connectors can require a costly and time consuming repair operation, especially if the damage occurs to the connector on the helicopter. Strain relief devices have been employed, however, they have not been effective in preventing damage to the connectors. The devices which have been used are clamps or grommets which fit around or grip all of the wires as a bunch at the rear of the connector.

SUMMARY OF THE INVENTION:

It is an object of the present invention to provide a strain relief system for an electrical connector and more particularly to a strain relief system for individually clamping the conductors extending from the rear end of an electrical connector.

The strain relief system comprises a wafer having a plurality of angularly spaced conductor receiving slots formed in its edge for receiving the conductors of the connector to allow said wafer to be located next to the rear end of the connector with each of the conductors located in one of the slots. A shell is adapted to be fitted around the wafer and removably connected to the housing of the connector. The shell has a plurality of openings formed through its wall at spaced positions such that each of the openings will be aligned with one of the slots when the shell is fitted around the wafer and connected in place to the housing. A plurality of inserts are provided equal in number to the number of slots formed in the wafer. Each insert is adapted to extend through one of the openings of the shell and into the slot of the wafer with which the opening is aligned when the shell is fitted around the wafer and connected to the housing. Each insert, when inserted into a slot, is adapted to engage the conductor in the slot. In addition, there is provided a clamping means adapted to surround the shell to engage the outer ends of the inserts for clamping the inserts in place in the slots against the conductors.

In a further aspect, the shell has a forward end adapted to be threaded to the housing with the rear end of the shell surrounding the wafer. The rear edge of the shell has an edge extending radially inward for holding the wafer in place next to the rear end of the connector when the shell is threaded in place to the housing. Each insert, when inserted into one of the slots, with its inner end in engagement with the conductor in the slot has its outer end extending through the aligned opening and projecting outward beyond the outer surface of the shell for engagement with the clamping band means.

In a further aspect, each insert has a concave inner edge formed in a first plane adapted to fit around a portion of the conductor in the slot into which the insert is inserted. In addition, each insert has an arcuate outer edge formed in said first plane and a slot formed in said outer edge in a plane perpendicular to said first plane for receiving the clamping band means.

BRIEF DESCRIPTION OF THE DRAWINGS:

FIG. 1 is a perspective front view of a connector employing the strain relief system of the present invention;

FIG. 2 is an exploded view of the strain relief system of FIG. 1;

FIG. 3 is a cross sectional view of FIG. 1 taken through the lines 3—3 thereof.

Figure 4:
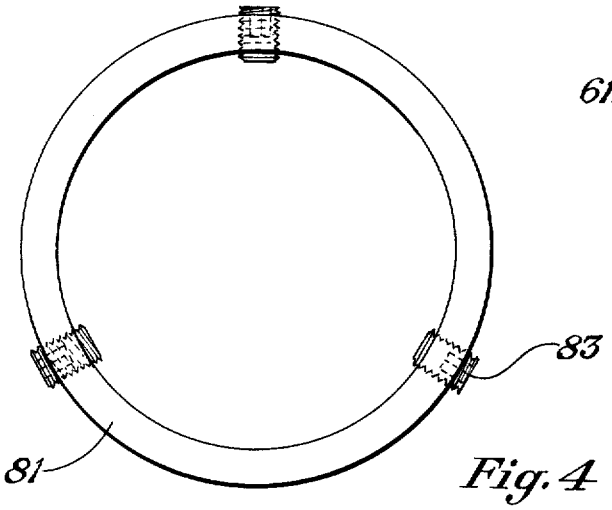
FIGS. 4–8 illustrate other clamping devices which may be employed in the strain relief system of the present invention in lieu of the clamping band or hose clamp of FIGS. 1–3.

DETAILED DESCRIPTION OF THE INVENTION:

Referring now to the drawings, a male connector is identified at 21. It comprises a cylindrical housing 23 having a front end 23A and a rear end 23B. Rotatably secured around the front portion of the housing is a coupling nut 25. In addition, threads 27 are formed around the outer surface of the housing near its rear end. Located in the housing is a flexible grommet 30 which may be of silicone rubber. As illustrated, the front end of the grommet is spaced inward from the front edge 23A of the housing while the rear end of the grommet projects rearward from the rear edge 23B of the housing. Formed through the grommet 30 between its front and rear ends are three large apertures 31 and three small apertures 32 (only one aperture 32 is shown). Three male contact pins 33 extend from the front end of the grommet 30 through apertures 31. Three electrical conductors 35 are electrically connected to the pins 33 inside the grommet 30 and extend from the rear end of the grommet through apertures 31, as illustrated in FIG. 2. The wires 35A of each conductor 35 are crimped to one of the contact pins 33. A thin spring retention clip (not shown) is located within the grommet 30 in the housing 23 for retaining the contact pins 33 in the desired position relative to the front end of the housing. The contact pins 33 may have a diameter of about 6/16 of an inch while the conductors 35 are of the heavy gauge type such as No. 1 gauge. The conductors 35, thus may have a diameter of the order of ½ of an inch and are relatively stiff. The purpose of the small apertures 32 is to provide a passage for three small flexible wires not shown. The soft pliable grommet 31 does not rigidly support the contact pins and conductors such that a direct axial load on the conductors or contact pins may result in damage to the retention clip. In addition, an angular load on the conductors may also result in damage to the retention clip, as mentioned above. In order to prevent such damage, clamps or grommets have been used at the rear of the connector which fit around or grip all of the conductors 35 as a bunch. These devices have not proved to be effective, as mentioned above. The purpose of the threads 27 is to allow the clamping devices to be threaded to the rear of the housing 23. In order to form a water proof seal at the rear end, a ferrule may be located around the rear projecting portion of the grommet 30. This ferrule may comprise part of the previously used clamping devices.

The strain relief system of the present invention comprises a circular shaped wafer 51 having three angularly spaced slots 53, formed in its outer edge 51A for receiving the conductors 35. As illustrated, the slots 53 extend radially inward from the outer edge and are located at 120° apart. The slots 53 have their inner edges 53A curved inward for snugly receiving the conductors 35. Also formed in the wafer 51 are three smaller slots 55 for receiving the small wires extending through the apertures 32. An annular ferrule 57 is provided which is adapted to fit around the rear portion of the grommet 30. When fitted in place, the rear end of the ferrule 57 will project rearward of the rear end of the grommet 30. With this arrangement, when the ferrule 57 is located in place, the conductors may be bent outward and inserted in the slots 53 and the wafer 51 located next to the rear end of the ferrule 57. In FIG. 2, one of the conductors 35 is shown located in a slot 53 while the other two conductors 35 are shown bent outward for insertion into the other two slots 53.

Also provided is a shell 61 having a front end 61A and a rear end 61B. The inside diameter of the shell 61 is slightly greater than the diameter of the water 51. Formed on the inside surface of the shell 61 at its front end are threads 63. An annular edge 65 is formed at the rear end of the shell 61. The annular edge 65 extends radially upward from the inside surface of shell 61 and has an inside diameter less than the diameter of the wafer 51. The shell 61 is adapted to be fitted around the wafer with its front end threaded to the threads 27 of the housing and the inside surface of the annular edge 65 in engagement with the rear of the wafer to hold the wafer in place next to the ferrule, with each of the conductors located in one of the slots. Three equally spaced openings 67 are formed through the wall of the shell at the rear end. The openings 67 are also located 120° apart such that they will be aligned with the slots 53 when the shell is fitted around the wafer and threaded to the housing. Three inserts 69 are provided which are adapted to be inserted through the openings 67 and into the slots 53 of the wafer 51, when the openings and slots are aligned, as shown in FIG. 3. When inserted in place, the inner edges of the inserts will engage the conductors while their outer ends will extend through the aligned openings and project outward beyond the outer surface of the shell. As shown, each insert has a concave inner edge 69A adapted to fit around the conductor in the slot into which the insert is inserted. Each insert has an arcuate outer edge 69B formed in the same plane as the concave edge 69A. A slot 69C is formed in the outer edge in a plane perpendicular to the plane of the concave edge 69A and the arcuate edge 69B. A removable clamping band 71 is adapted to surround the shell and fit in the slots 69C formed in the arcuate outer edges of the inserts for clamping in inserts in place in the slots against the conductors. As illustrated, the band 71 is a conventional hose clamp having an adjustable threaded member 73 for adjusting the tightness of the clamp. With the arrangement shown, each conductor 35 will be individually clamped in place between an insert and the wafer which in turn is held by the shell 61 threaded to the housing. Thus, the heavy duty conductors are individually clamped in effect to the housing of the connector and any axial or angular force applied to the conductors 35 will not affect the thin spring retention clip in the housing nor the contract pins 33. In addition, an axial force applied to the contact pins 33, for example, during connect operations will not damage the retention clip. Moreover, as can be understood, the strain relief system of the present invention can be readily inserted in place and removed from existing connectors thereby eliminating any re-design of the connectors or modifications thereof.

Referring now to FIGS. 4–8 there will be described other clamping devices which may be employed in lieu of the clamp 71 to clamp the inserts 69 in place. In FIG. 4 there is disclosed a ring 81 having an inside diameter sufficient to allow it to be fitted around the arcuate edges 69B of the inserts 69 when they are inserted in place in the apertures 53. The ring 81 has three threaded apertures spaced 120° apart for receiving three set screws 83. For clamping purposes the ring 81 will be positioned around the inserts 69 to align its three threaded apertures with the three inserts 69 whereby the set screws 83 may be threaded inward to allow their inner edges to tightly engage the outer arcuate edges 69B of the inserts 69 within their slots 69C.

Figure 5:
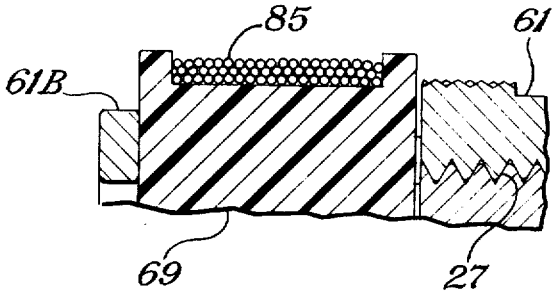

In FIG. 5 there is disclosed a wire 85 wrapped tightly around the inserts 69 in their slots 69C for clamping the inserts in place.

Figure 8:
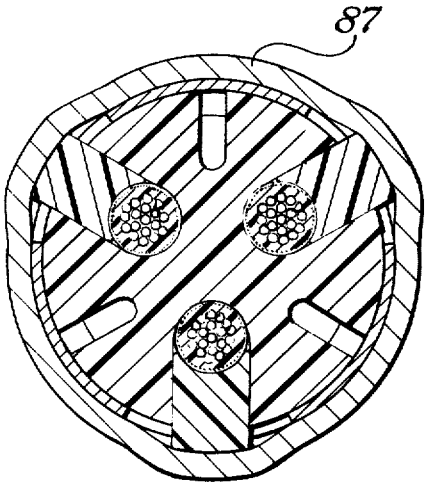
Figure 7:
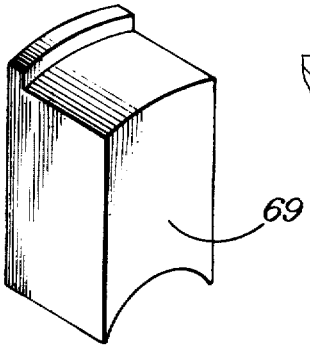
Figure 6:
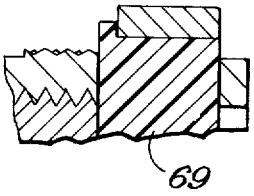

In FIGS. 6–8 there is disclosed a solid metal band 87 crimped around the inserts 69. In this embodiment one of the outer edges of each insert 69 defining its slots 69C is removed to allow the band 87 to be fitted around the inserts 69 with a fairly close tolerance fit prior to crimping. Instead of a metal band 87, a heat shrinkable plastic band may be employed.

Although the connector illustrated is a male connector, it is to be understood that the strain relief system of the present invention may be employed on female connectors. The female connector will be similar to the male connector except that socket contacts will be supported in the grommet 30 rather than pins 33. Although the connector illustrated has three contacts and three heavy duty conductors, such connectors may employ two, four, five, six, etc. heavy duty conductors and associated contacts. The strain releif system of the present invention may be readily modified to be connected to such connectors by forming two, four, five, six, etc. equally spaced slots 53 in the wafer rather than three slots. An insert 69 will be provided for each slot.

The wafer 51 and inserts 69 are relatively hard members and may be formed of glass filled epoxy or diallyl thyalate. The wafer 51 has a diameter of about 2-5/32 inches. The inside diameter of shell 61 is about 2-7/32 inches while the inside diameter of annular edge 65 is about 1-14/16 of an inch.

I claim:

1. A strain relief system for an electrical connector, said connector comprising a housing having a front end and a rear end, a plurality of contact members supported at said front end of said housing, and a plurality of electrical conductors extending from the rear end of said connector, each conductor being connected to one of said contact members, said strain relief system comprising:

a wafer having a plurality of angularly spaced conductor receiving slots formed in its edge for receiving said conductors to allow said wafer to be located next to the rear end of said connector with each of said conductors located in one of said slots, a shell adapted to be fitted around said wafer and removably connected to said housing, said shell having a plurality of openings formed through its wall at spaced positions such that each of said openings will be aligned with one of said slots when said shell is fitted around said wafer and connected in place to said housing, a plurality of inserts equal in number to the number of said conductor receiving slots formed in said wafer, each insert being adapted to be inserted through one of said openings of said shell and into the slot of said wafer with which the opening is aligned when said shell is fitted around said wafer and connected to said housing, each insert, when inserted into a slot, being adapted to engage the conductor in the slot, and clamping means adapted to surround said shell and to engage the outer ends of said inserts for clamping said inserts in place in said slots against said conductors.

2. The strain relief system of claim 1 wherein:

said housing is a cylindrical housing means, the outer periphery of said wafer is circular in form, each slot extends radially inward from the outer periphery of said wafer, said shell is a cylindrical member having a forward end adapted to be threaded to said cylindrical housing means with the rear end of said shell surrounding said wafer, the rear edge of said shell has means extending radially inward for holding said wafer in place next to the rear end of said connector, each insert, when inserted into one of said slots, with its inner end in engagement with the conductor in said slot, having its outer end extending through the aligned opening and projecting outward beyond the outer surface of said shell for engagement with said clamping band means.

3. The strain relief system of claim 2 wherein:

each insert has an arcuate outer edge formed in said first plane and a slot formed in said outer edge in a plane perpendicular to said first plane for receiving said clamping band means.

4. A strain relief system for an electrical connector, said connector comprising a cylindrical housing means having a front end and a rear end with threads formed around its outer surface near its rear end, a flexible grommet located in said housing with its rear end projecting rearward beyond the rear end of said housing, a plurality of contact members supported by said grommet at said front end of said connector, and a plurality of electrical conductors extending through the rear end of said grommet, each conductor being connected to one of said contact members, said strain relief system comprising:

a ferrule adapted to be fitted around the rear end of said grommet, a circular wafer having a diameter about equal to the outside diameter of the rear end of said housing and a plurality of angularly spaced conductor receiving slots formed in its edge for receiving said conductors to allow said wafer to be located next to said ferrule with each of said conductors located in one of said slots, a cylindrical shell having an inside diameter slightly greater than the diameter of said wafer, said shell having a front end and a rear end with threads formed on its inside surface at its front end and an inward extending annular edge at its rear end having an inside diameter less than the diameter of said wafer, said shell being adapted to be fitted around said wafer with its front end threaded to the rear end of said housing and the inside of its annular edge in engagement with said wafer to hold said wafer in place next to said ferrule with each of said conductors located in one of said slots, said shell having a plurality of openings formed through its wall at its rear end at angularly spaced positions such that each of said openings will be aligned with one of said slots when said shell is fitted around said wafer and threaded to said housing, a plurality of inserts equal in number to the number of said conductor receiving slots formed in said wafer, each insert being adapted to be inserted through one of said openings of said shell and into the slot of said wafer with which the opening is aligned when said shell is fitted around said wafer and threaded to said housing, each insert has a concave inner edge formed in a first plane adapted to fit around and engage a portion of the conductor in a slot into which the insert is inserted, each insert, when inserted into one of said slots, with its inner edge in engagement with the conductor in the slot, having its outer end extending through the aligned opening and projecting outward beyond the outer surface of said shell, each insert has an arcuate outer edge formed in said first plane and a slot formed in said outer edge in a plane perpendicular to said first plane, a removable clamping band means adapted to surround said shell and to fit in the slots formed in the arcuate outer edges of said inserts for clamping said inserts in place in said slots against said conductors.

* * * * *